United States Patent [19]

Moses

[11] 4,162,695

[45] Jul. 31, 1979

[54] HANDBAG WITH THERMAL THEFT PROTECTION SYSTEM

[76] Inventor: Lawrence L. Moses, 3728 Cherrywood Ave., Los Angeles, Calif. 90018

[21] Appl. No.: 928,740

[22] Filed: Jul. 28, 1978

[51] Int. Cl.[2] ..... A45C 1/08

[52] U.S. Cl. ..... 150/35; 150/28 R; 150/47; 219/211

[58] Field of Search ..... 150/28 R, 33, 34, 35, 150/47; 190/42; 219/211, 212, 527, 528, 529, 545, 549

[56] References Cited

U.S. PATENT DOCUMENTS

| | | | |
|---|---|---|---|
| 1,284,378 | 11/1918 | Lemercier | 219/211 |
| 1,312,830 | 8/1919 | Camm | 219/211 |
| 2,082,468 | 6/1937 | Pupier | 219/529 |
| 3,443,066 | 5/1969 | Weibel | 219/529 |
| 3,501,616 | 3/1970 | Arron | 219/529 |
| 3,781,514 | 12/1973 | Olson | 219/545 |

FOREIGN PATENT DOCUMENTS

| | | | |
|---|---|---|---|
| 673915 | 3/1939 | Fed. Rep. of Germany | 150/35 |
| 1357492 | 2/1964 | France | 150/35 |

*Primary Examiner*—Ro E. Hart
*Attorney, Agent, or Firm*—I. Morley Drucker

[57] ABSTRACT

A handbag is provided with a switching means which is activated when an excessive removal force is applied to the handbag's carrying strap. The switching means is connected in series with a battery and resistance wires. The wires preferably run under the outer surface of the bag and are elevated to a high temperature by electrical current, forcing a person holding the bag to release the same.

6 Claims, 5 Drawing Figures

Fig. 1
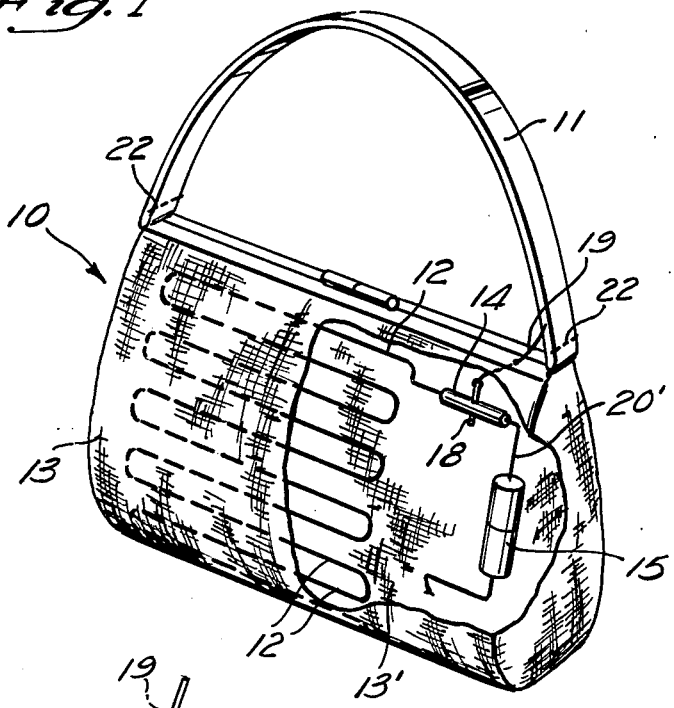
Fig. 3
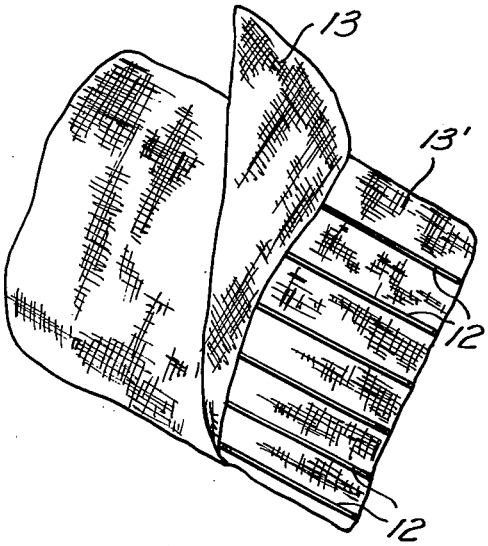
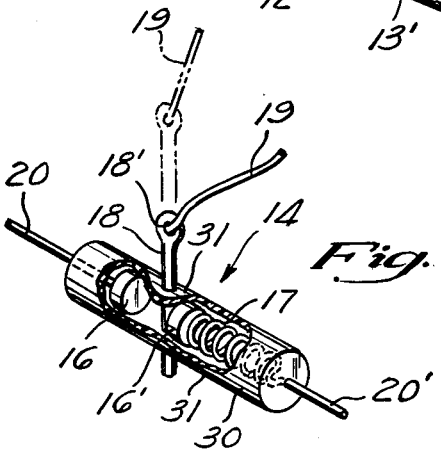
Fig. 2
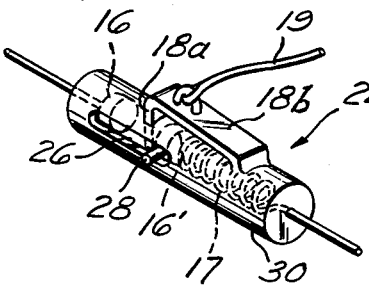
Fig. 4
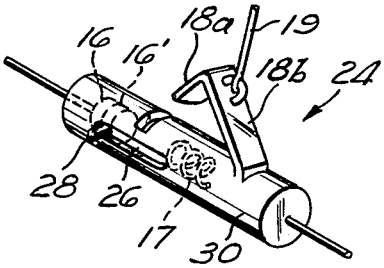
Fig. 5

HANDBAG WITH THERMAL THEFT PROTECTION SYSTEM

BACKGROUND OF THE INVENTION (1) Field of the Invention

This invention relates generally to anti-theft devices and, more particularly, is directed towards a handbag provided with a battery-powered heating system which under theft conditions enables the handbag to be heated to a very high temperature in excess of that normally tolerted by a human being.

(2) Description of the Prior Art

"Purse-snatching" is a common crime where as assailant takes a purse or handbag from the person carrying it by pulling on the bag with such force that the owner is forced to release it. Often there is no opportunity for resistance because the attack is carried out by surprise. In many cases, the carrying strap of the purse is torn away at one of its joints since the owner instinctively attempts to retain possession of the bag, and also because the strap may be looped over the owner's shoulder or arm and instead of slipping off the owner's body during the forcible taking, the strap may break at its weakest point, usually one of the joints between the carrying strap and the container.

Many devices have been developed to prevent or deter such crimes but there is a continuing need for improvement in this field. Most existing systems rely on a battery operated audible alarm which is activated automatically either when the handbag is "snatched" or upon opening of the bag by the thief. Representative of such devices are those disclosed in U.S. Pat. Nos. 3,851,326, 3,851,118 and 3,893,096.

Although an audible alarm may attract attention to the theft, such devices do not physically prevent the actual taking away of the handbag and its removal from the owner's immediate vicinity.

SUMMARY OF THE INVENTION

This invention is directed towards a theft protection device for portable containers such as handbags or purses. The handbag is provided with electrical resistance wires in close proximity to its outer surface, a battery, and a switch means connected in series. A non-conductive restraining pin or tab is removably interposed between the electrical contacts of the switch means and is also attached to a portion of the handbag's carrying strap. Upon application of an excessive removal force to the carrying strap, the strap breaks away from the purse thereby pulling the restraining pin or tab from the switch means, causing the switch means to close. Electrical current supplied by the battery then flows through the electrical resistance wires, heating the same to a high temperature and thereby forcing a thief to release the handbag.

BRIEF DESCRIPTION OF THE DRAWINGS

FIG. 1 is a partially cutaway perspective view of a handbag incorporating the present invention;

FIG. 2 is a partially cutaway perspective view of one embodiment of the switching means for the heating circuit, of the present invention;

FIG. 3 is a perspective view showing heating wires between two layers of fabric;

FIG. 4 is a perspective view of a second embodiment of a switching means shown in its open position wherein the heating circuit is inactivated; and FIG. 5 is a perspective view of the switching means of FIG. 4, shown in its closed state wherein the heating circuit is activated.

DESCRIPTION OF THE PREFERRED EMBODIMENT

In FIG. 1 of the drawings is shown a purse or handbag 10 with a carrying strap 11 attached thereto. A plurality of electrical resistance wires 12 is sandwiched between the layers of fabric 13 and 13' of which the handbag 10 is constructed and is in close thermal proximity to outer fabric layer 13. The wires 12 are spaced in an approximately even manner within the handbag walls so as to encompass a greater portion of the wall area and, in particular, those areas of the walls by which a thief is most likely to seize the handbag.

FIGS. 1 and 3 show a suggested layout of the resistance wires 12 in the form of a serpentine grid. The wires may then be bare or of the insulated type, the insulation being preferably made of a plastic resistant to temperatures of up to at least 250° F. The arrangement shown in FIGS. 1 and 3 has the specific advantage that a bare, i.e., non-insulated conductor or wire may be used, since there would be no opportunity for the wire to short circuit itself as in a grid pattern. It will be apparent to those skilled in the art that many alternate layout patterns of the resistance wires 12 are possible without departing from the spirit and scope of the present invention, e.g., as in a rectangular grid arrangement where insulated resistance wires are to be employed.

Purse 10 has an opening for access thereto (the access not being shown). Within the purse and attached thereto is a switching means 14 which is connected in series with a battery 15 and resistance wires 12 to provide a heating circuit as will be described.

As best seen in FIG. 2, switching means 14 comprises a pair of electrical contacts 16 and 16' contained in a non-electrically conductive cylindrical housing 30. Electrical contact 16 is fixed and the other contact 16' is attached to one end of an electrically conductive metallic coil spring 17.

The electrical contacts 16 and 16' of the switching means are normally held apart, to inactivate the entire heating circuit, by means of a non-conductive circuit breaker member, shown by way of example, as a plastic retaining pin 18. Retaining pin 18 is removably inserted through aligned openings in the walls 31 of the housing 30 between the contacts 16, 16' and causes coil spring 17 to be normally maintained in compression.

The electrically conductive spring 17 forms part of the electrical circuit path of the heating circuit. A pair of electrical leads 20 and 20' are connected to said fixed contact 16 and to spring 17 respectively, these leads 20 and 20' being in turn connected to resistance wires 12 and to battery 15, respectively.

The upper end of pin 18 is provided with an eye or loop means 18' to which is affixed one end of a strong, flexible cord member 19, e.g., made of nylon. The other end of cord 19 is affixed to handbag carrying strap 11. The strap 11 has weakened joints 22 located at each end thereof. Strap 11 is designed to break away between the weakened joints when a sufficient removal force is applied to the bag itself and said removal force is transmitted through cord member 19 to retaining pin 18 so as to pull out said retaining pin 18 from switch 14, thus permitting spring 17 to decompress and urge electrical contact 16 into engagement with contact 16' and thereby completing the electrical heating circuit.

As an alternative to providing a strap 11 with areas or joints of weakened strength, one could provide the ends of the strap 11 with spring clips (not shown) engageable with the ends of the handbag, but disengageable therefrom when a large, force is exerted between bag 10 and strap 11.

FIGS. 4 and 5 show a second embodiment of a switching means 24 wherein the circuit breaker member pin 18 in FIGS. 1 and 2 is replaced by an L-shaped restraining tab having a first portion 18*a* interposed between contacts 16 and 16' and a second portion 18*b*pivotally attached to the switch housing. This arrangement has the advantage that the tab is never removed from the switch, but is merely bent away from its restraining mode by the removal force transmitted through connecting member 19.

Upon closing of switching means 14, due to a removal force exerted between bag 10 and strap 11, a surge of electrical current flows through resistance wires 12. The total resistance of resistance wires 12 is selected, by methods well known to those skilled in the art, so that taken in conjunction with the voltage and current capabilities of the battery, said resistance wires 12 will be heated to a high temperature by said electrical current. The temperature of the wires is such as to very quickly transmit sufficient heat through the outer layer of fabric 13 to create considerable discomfort to a person touching the surface of handbag 10 at a point adjacent to said wires and so as to cause such a person to release said handbag.

Battery 15 is also contained within the handbag and may be removably mounted therein.

A further features of the switch means 14 and 24 illustrated in FIGS. 4 and 5 of the drawings is a longitudinal slot 26 in the wall of housing 30 enclosing said switch, parallel to the axis of spring 17 and a resetting pin 28 attached to contact 16' and protruding through said slot for the purpose of restoring the switch to its open state after it has been triggered. Resetting is accomplished by pushing resetting pin 28 backwards in order to compress spring 17, thereby separating electrical contacts 16 and 16', and then re-inserting the circuit breaker member, herein restraining pin 18, between said contacts.

It should be noted that the high temperature need not be maintained for a prolonged period of time. A surge of heat as short as a few seconds in duration may suffice to deter a thief. It should further be noted that the temperature generated by the current flow in resistance wires 12 need not be such as to cause combustion of the handbag fabric, nor even such as to cause said resistance wires to become incandescent.

A significant advantage of the thermal protection system over the audible alarm system of the prior art is that the present invention does not call for the intervention of bystanders to foil the theft. Many persons would be reluctant to intervene in such a situation. Those who choose to do so may be risking serious bodily injury to themselves and others in order to protect replaceable personal property. The present invention does not create such problems, since it merely makes it very difficult for the would-be thief to hold on to the handbag or purse.

It will be apparent to those skilled in the art that the thermal theft prevention system disclosed herein may be adapted to many types of portable or hand carried containers, and that it is not limited to usage with purses or handbags. It should be further understood that various modifications may be made in the present invention without departing from the spirit and scope thereof as described in the specification and defined in the appended claims.

I claim:

1. A handbag with theft protection device comprising:

a bag portion having an opening for access thereto;

a carrying strap attached to said bag portion;

a source of electrical current;

a heating means to heat the outer surface of said handbag to a high temperature;

a switch means connected in series with said heating means and said source of electrical current; and a removable non-conductive circuit breaker member connected to said carrying strap and the switch means, which circuit breaker member activates the switch means when an excessive removal force is applied to the carrying strap.

2. A handbag as recited in claim 1, wherein the switch means further comprise:

a first and second electrical contact means;

a spring means adapted to engage said first electrical contact means with the second electrical contact means; and said removable non-conductive circuit breaker member having a first portion thereof normally interposed between said first and second electrical contact means to prevent electrical contact thereof and a second portion operatively engaged to said carrying strap and upon application of excessive removal force to said carrying strap, said non-conductive circuit breaker member is removed from its normal position to activate said switch means.

3. A handbag as recited in claim 1 wherein said heating means comprise a plurality of electrical resistances adapted to be elevated to a high temperature by an electrical current passing through said electrical resistances; and said electrical resistances are distributed within the handbag walls in close thermal proximity to the outer surface thereof.

4. A handbag as recited in claim 3 wherein said electrical resistances comprise electrical resistance wire.

5. A handbag as recited in claim 1 wherein a portion of said carrying strap is adapted to break away from said handbag upon application of excessive pull force and said circuit breaker member is attached to said portion.

6. A handbag as recited in claim 1 wherein said source of electrical current is a battery.

* * * * *